6/9/87 XR 4,670,954

United States Patent [19]

Lisec

[11] Patent Number: 4,670,954

[45] Date of Patent: Jun. 9, 1987

[54] APPARATUS FOR FILLING HOLLOW MEMBERS WITH GRANULATED MATERIAL

[76] Inventor: Peter Lisec, Bahnhofstrasse 34, A-3363 Amstetten-Hausmening, Austria

[21] Appl. No.: 802,383

[22] Filed: Nov. 27, 1985

[30] Foreign Application Priority Data

Mar. 18, 1985 [AT] Austria ..... 804/85

[51] Int. Cl.[4] ..... B65B 7/28; E06B 1/16

[52] U.S. Cl. ..... 29/33 K; 29/455 R; 29/564.1; 29/DIG. 63; 53/267; 406/154; 406/195

[58] Field of Search ..... 406/195, 154, 175; 51/439; 52/172, 171; 29/33 K, 33 R, 455 R, 564.1, DIG. 63; 53/284, 281, 267, 266 R, 329, 319, 468, 471, 478, 489; 141/67, 98

[56] References Cited

U.S. PATENT DOCUMENTS

| | | | |
|---|---|---|---|
| 3,380,145 | 4/1968 | Stroud et al. | 29/455 R X |
| 4,279,065 | 7/1981 | Sernevi | 53/284 X |
| 4,356,614 | 11/1982 | Käuferle et al. | 29/455 R X |
| 4,453,865 | 1/1984 | Norton | 406/108 X |
| 4,494,283 | 1/1985 | Lisec | 29/79 X |

*Primary Examiner*—James F. Coan

*Attorney, Agent, or Firm*—Young & Thompson

[57] ABSTRACT

An apparatus is disclosed for filling spacer frames for insulating glass with hygroscopic granulated material wherein the conduit connecting a storage tank with the discharge opening for the granulated material exhibits a section having a relatively large cross section and a section having a relatively small cross section, which latter section is turned in the upward direction and the axis of which is offset in the upward direction with respect to the axis of the section having a relatively large cross section. This apparatus is utilized, for example, in a machine for filling spacer frames for insulating glass including two processing arrangements with which holes can be produced in legs of the spacer frame, granulated material can be introduced, and the holes can be resealed. The processing arrangements comprise a plate contacted by the respective leg of the spacer frame and provided with a hole for the passage of a drill as well as the orifices of the conduit for the granulated material and of a duct for sealing compound. In order to place the legs of the spacer frame, seized by clamping devices, in sequence into alignment with the hole for the drill and the orifices for the ducts, the clamping installations and the plate are displaceable relatively to each other.

22 Claims, 12 Drawing Figures

APPARATUS FOR FILLING HOLLOW MEMBERS WITH GRANULATED MATERIAL

Figure 1:
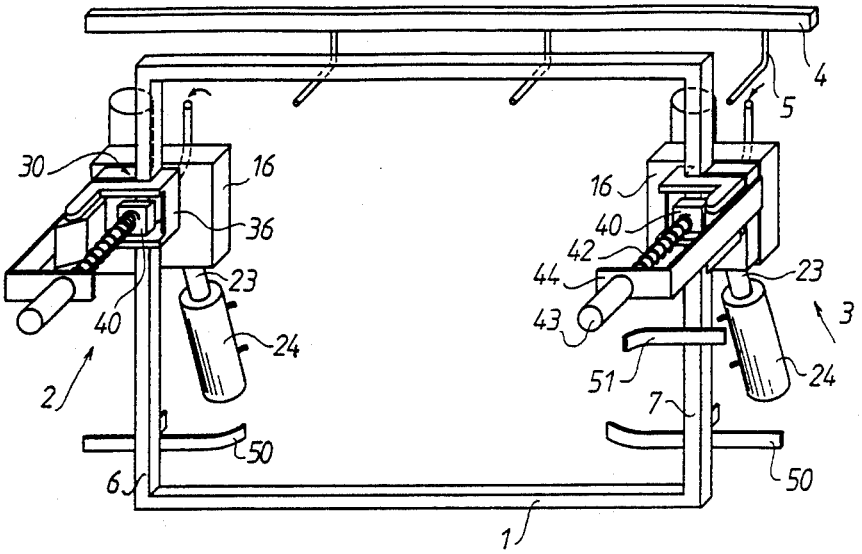

The invention relates to an apparatus for filling hollow members with granulated material, especially spacer frames for insulating glass with granular, hygroscopic material, comprising a conduit connecting a storage tank for the granulated material with a discharge opening.

The spacer frames of insulating glass panes are routinely filled with granular, hygroscopic material (molecular sieve) in order to absorb the moisture contained in the interior of the pane. In case of spacer frames composed of linear hollow moldings with the use of corner angles, the procedure ordinarily is to fill the hollow molding sections with the hygroscopic material and then sealing them on both ends with foam plugs. This can be done, for example, with the aid of the apparatus known from Austrian Pat. No. 365,551.

Spacer frames for insulating glass manufactured from a single hollow molding by repeated bending cannot be filled with the hygroscopic material prior to bending since, on the one hand, too much time is lost until the spacer frame is installed in the insulating glass and a considerable portion of the capacity of the hygroscopic material is exhausted before the insulating glass is finished and, on the other hand, granules are crushed into dust during bending of the hollow molding, which dust then penetrates into the interior of the pane through the openings in the hollow molding and is precipitated on the inner surfaces of the glass panes. Therefore, an apparatus has been suggested furthermore (see DOS No. 3,224,862) making it possible to fill spacer frames for insulating glass, that have been bent in one piece, with a hygroscopic material.

One problem of handling granular, hygroscopic material resides in that the latter is very abrasive so that conventional shutoff elements, such as valves, slides, and the like utilized for controlling the bulk stream are subject to very rapid wear. On the other hand, there is the danger that the granulated material is crushed into dust upon operation of the shutoff elements, whereby again the aforedescribed drawback occurs.

The invention is based on the object of providing an apparatus of the type discussed hereinabove which makes it possible to control the bulk stream when filling hollow members, especially spacer frames, without the danger of crushing the granules and without provision of shutoff elements subject to increased wear and tear.

In attaining this object, an apparatus for filling hollow members with granulated material is characterized in that the conduit for the granulated material is turned upwardly upstream of the discharge opening and exhibits, directly upstream of the discharge opening, a section having a cross section smaller than the cross section of the remaining portion of the conduit; that the axis of the section having the smaller cross section is offset, particularly offset in the upward direction, with respect to the axis of the conduit section in its zone adjoining the section of the conduit having a smaller cross section; and that the conduit is associated with a vibration generator and/or with a device for the production of a conveying gas stream.

In the apparatus of this invention, the granulated material, as long as the vibration generator and/or the conveying gas stream are effective, travels through the conduit for the granulated material via the discharge opening into the hollow member to be filled. However, as soon as the vibration generator is arrested and/or the conveying gas stream is interrupted, the granulated material accumulates in the transition from the conduit section having the larger cross section into the conduit section having the smaller cross section, which is further enhanced by the feature that the portion of the conduit adjoining the discharge opening is turned upwards. As soon as the vibration generator and/or the conveying gas stream become again operative, the choking action in the granulated material is eliminated, and the material again flows into the hollow member to be filled.

It can be seen that, based on the special structure of the conduit of the apparatus of this invention for the filling of hollow members with granulated material, no shutoff elements with moving parts at all are necessary in the conduit for the interruption of the bulk stream.

In one embodiment of the invention, the provision can be made that the storage tank for the granulated material is disposed above the discharge opening, the section of the conduit having the larger cross section being bent from a vertical portion into a horizontal portion of the conduit. This embodiment has two advantages namely that, on the one hand, the formation of the stagnation zone for interrupting the bulk stream is facilitated and that, on the other hand, the granulated material fills the hollow member even in a section lying above the discharge opening.

Entrance of the granulated material from the discharge opening into the hollow member to be filled is made easier if the zone of the conduit section having the smaller cross section which is in the immediate vicinity of the discharge opening extends essentially horizontally.

Another possibility for facilitating the formation of the stagnation zone in the conduit, interrupting the bulk stream, resides in orienting the section of the conduit having the smaller cross section to extend obliquely upwardly.

In another embodiment of the invention, the provision can be made that the end of the conduit section having the larger cross section that adjoins the conduit section having the smaller cross section is oriented horizontally.

If hollow members are to be filled out entirely by means of the apparatus of this invention, the end of the filling procedure can be determined in a simple way by associating with the conduit for the granulated material a bulk stream detector. In this connection, among various bulk stream detectors, one arrangement has proven itself well wherein the bulk stream detector monitors the movement of the granulated material in the conduit in accordance with the radar principle.

According to one embodiment of the invention, the provision is made that the bulk stream detector, with the granulated material in the conduit being at a standstill, transmits a control signal arresting the vibration generator and/or the device for producing the conveying gas stream. In this embodiment, the hollow member to be filled can be removed from the apparatus after completion of the filling step without there being the danger that additional granules exit from the discharge opening, because the choking action is created immediately after arresting the vibration generator and/or the bulk flow in the conduit for the granules.

The invention furthermore concerns an apparatus for filling spacer frames for insulating glass of the type known from DOS No. 3,224,862 equipped with at least one, but preferably two filling devices of this invention, and with a holder for the spacer frame to be filled, and with at least one, but preferably two processing arrangements mounted at a machine frame, each arrangement being provided with a drilling means for producing filling openings in the spacer frame to be filled, and with a device for sealing the filling openings after termination of the filling operation.

Such an apparatus is characterized, according to this invention, by the features that the holder of the processing arrangement comprises a clamping device engaging at a leg of the spacer frame and a pressure piston; that the processing means comprises a plate lying in opposition to the pressure piston and exhibiting a contact surface extending in parallel to the plane of the spacer frame, this contact surface containing, in side-by-side position, a hole for the passage of a drill of the drilling device, a duct for the granulated material, and a duct for a compound for sealing the filling opening in the spacer frame; and that drive motors are provided for a relative movement between the plate and the spacer frame, in order to arrange the leg of the spacer frame so that it faces first the hole for the drill, then the orifice of the duct for the granulated material, and finally the orifice of the duct for the compound for sealing the filling opening in the spacer frame.

In the apparatus of this invention, the leg or legs of the spacer frame via which the filling operation is to proceed is or are reliably retained by the specially configured clamping device. Moreover, the movements to be executed during the filling process are limited to linear displacements for moving the spacer frame into the correct position for the respective working step (drilling, filling, sealing). This represents a not inconsiderable structural simplification as compared with the apparatus known from DOS No. 3,224,862.

In case two processing arrangements are provided in the apparatus of this invention, affording the advantage that the spacer frame can be filled simultaneously via two of its legs, thus considerably reducing the filling period, it is recommended within the scope of this invention to dispose one of the processing arrangements fixedly in the machine frame and to guide the other processing arrangement so that it is reciprocated in the horizontal direction; as a result, the spacing of the processing arrangements can be adapted to varying frame sizes. This embodiment also includes the advantage that the spacer frame is correctly aligned by the movable adjustment of the mobile processing arrangement also with respect to the fixed processing arrangement.

One embodiment of the invention includes the provision that the pressure piston for urging the spacer frame against the plate is arranged, in the rest position, in exact opposition to the orifice of the duct for the granulated material and seals off the orifice when the spacer frame is removed. This piston therefore performs a dual function; on the one hand, it retains the spacer frame in contact with the plate and, on the other hand, it closes the orifice of the conduit for the granulated material so that the granulated material is protected from moisture.

In a practical embodiment of the apparatus according to this invention, the provision can be made that the processing arrangement, or each processing arrangement, comprises a base plate and an auxiliary plate displaceable with respect to the latter, wherein the movable auxiliary plate carries the plate with the hole for the drill of the drilling tool and the ducts for the granulated material and, respectively, for the compound for sealing the filling opening in the spacer frame, as well as a storage cylinder for the compound for sealing the opening in the spacer frame, and the base plate carries the clamping device and the pressure piston. This arrangement has the advantage, inter alia, that, after sealing the opening produced in the spacer frame, any compound protruding past the spacer frame is wiped off by a sliding motion of the spacer frame with respect to the plate. In the just-mentioned embodiment of the apparatus of this invention, the additional feature can be included that the auxiliary plate is guided on the base plate by way of a horizontal rail, and in the zone of its lower edge between rollers on the base plate.

Metered feeding of the compound for sealing the opening(s) produced in the spacer frame is made especially simple by associating an advanceable plunger with a storage cylinder for the compound for sealing the filling opening in the spacer frame, making it possible to force a predetermined amount of compound, required for a sealing step, into the duct arranged in the plate for the compound for sealing the filling opening in the spacer frame, and by accommodating within the duct an advanceable plunger for forcing the compound out of the duct into the filling opening in the spacer frame.

According to another embodiment of the invention, the provision can be made that the clamping device at the processing arrangement comprises a stop rigidly mounted to the base plate and a clamping jaw which latter can be brought into contact with the leg of the spacer frame and is pivotably mounted at the base plate. In this embodiment, the spacer frame is clamped in place from both sides and is additionally urged against the plate by the pressure piston so that it is held securely during the relative motions between the spacer frame and the plate. In detail, the provision can be made that the pivotable clamping jaw is of an angled design and is mounted, by way of two legs perpendicularly located with respect to its pressure surface, at the base plate to be pivotable about a preferably vertical axis. A spatially advantageous arrangement is obtained if, according to another suggestion of this invention, the pressure piston extends through the clamping jaw between the legs of the latter.

In accordance with a further development of the invention, the provision can be made that the drilling means is mounted to the base plate, for executing the drilling work, to be advanceable transversely to the plane of the spacer frame.

According to another embodiment of the invention, the provision is made that a horizontally oriented strip equipped with hooks is attached to the frame of the apparatus, these hooks serving for suspending a spacer frame therein; and that the processing arrangement(s) is (are) associated with one vertical leg (the vertical legs) of the spacer frame. In this embodiment, it is sufficient to hang the spacer frame into the apparatus, whereupon, by adjusting the movable processing arrangement, it is correctly disposed by the stops of the clamping devices, for performance of the filling operation, with respect to both processing arrangements. This is accomplished in a particularly simple way by adapting the stop of the clamping device to contact the outer surface, and the clamping jaw to contact the inner surface of a leg of the spacer frame. In this connection, the additional provision can be made that the plate with the hole for the drill and the ducts for the granulated material and/or the sealing compound for closing the filling opening of the spacer frame can be brought into contact with a surface of a leg of the spacer frame extending in parallel to the plane of the spacer frame.

In order to prevent the spacer frame suspended on the hooks from pendulating as long as the clamping device(s) has (have) not as yet seized the leg(s) of the spacer frame, the provision can be made within the scope of this invention to arrange guide strips for the vertically downwardly hanging legs of the spacer frame at the processing units; here, the guide rail located at the fixed processing arrangement and the guide rail disposed at the movable processing arrangement are in contact with the side of the spacer frame facing the machine frame.

Furthermore, a guide rail can be provided at the movable processing arrangement which engages on the side of the spacer frame facing away from the machine frame, this guide rail being arranged preferably higher than the guide rail. This ensures that the leg of the spacer frame associated with the movable processing arrangement is moved into the proximity of the plate, when the movable processing arrangement is adjusted, even before closing the clamping device and advancement of the pressure piston.

Figure 2:
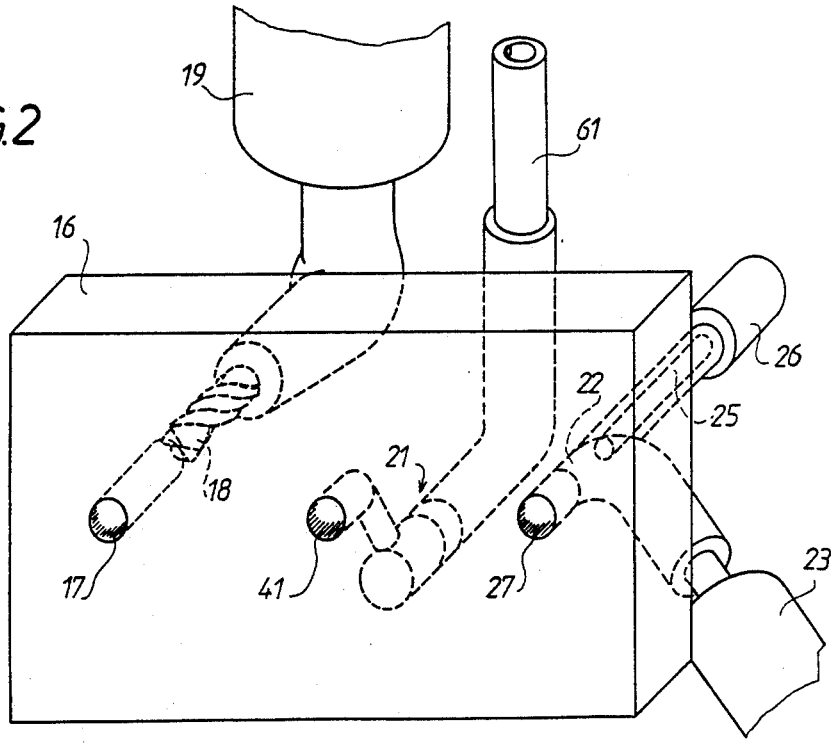
Figure 1A:
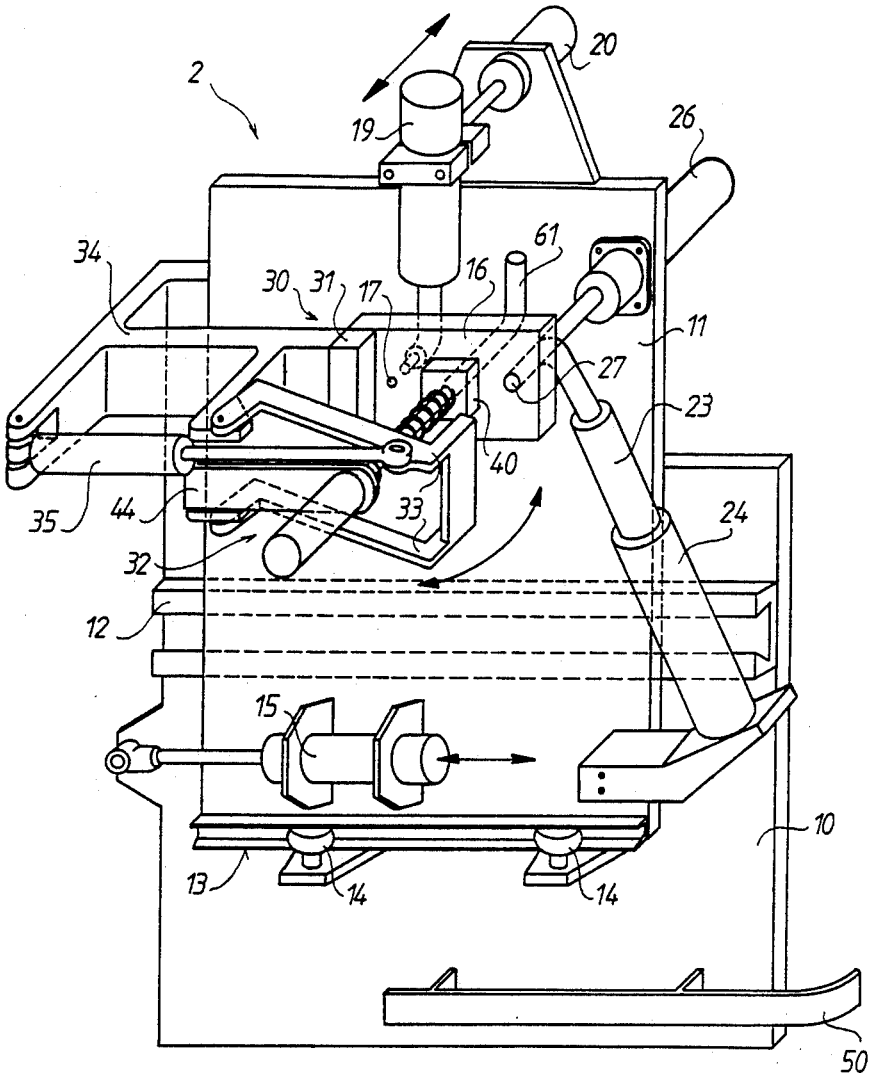
Figure 1B:
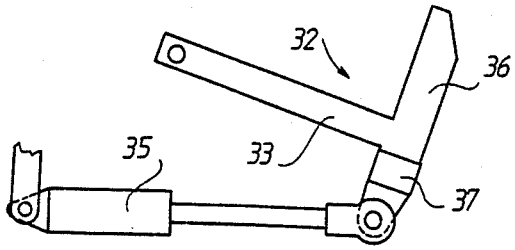
Figure 8:
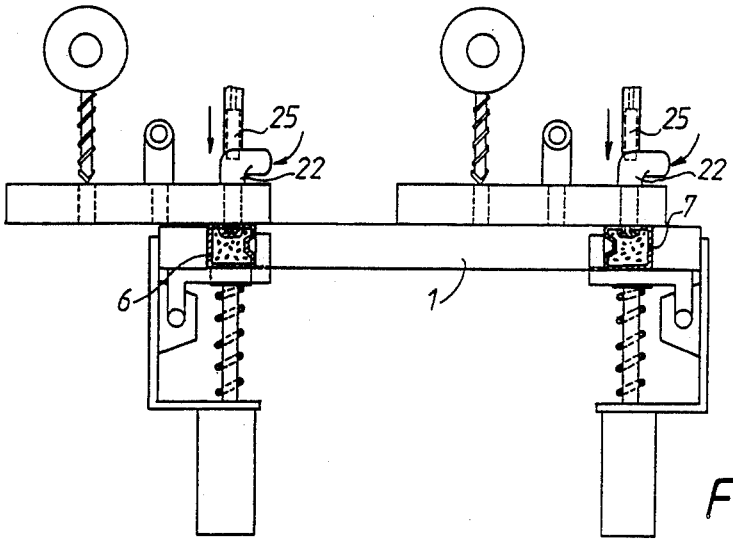
Figure 9:
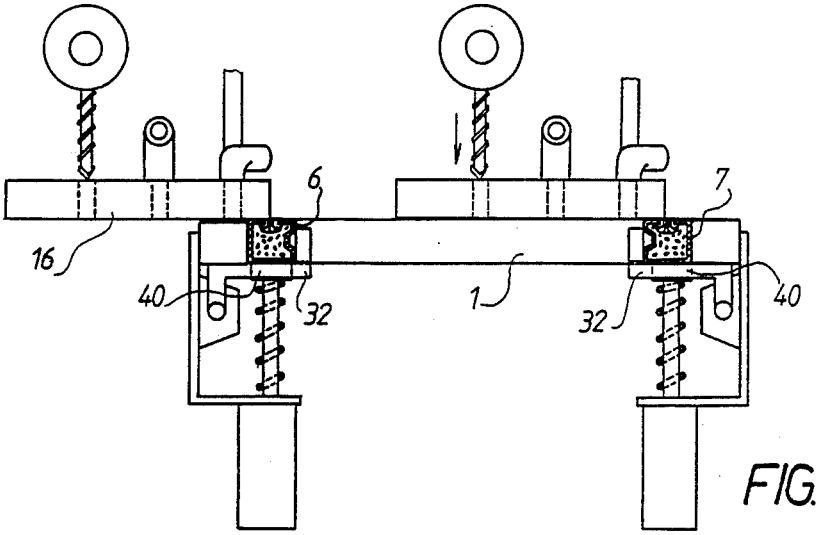
Figure 10:
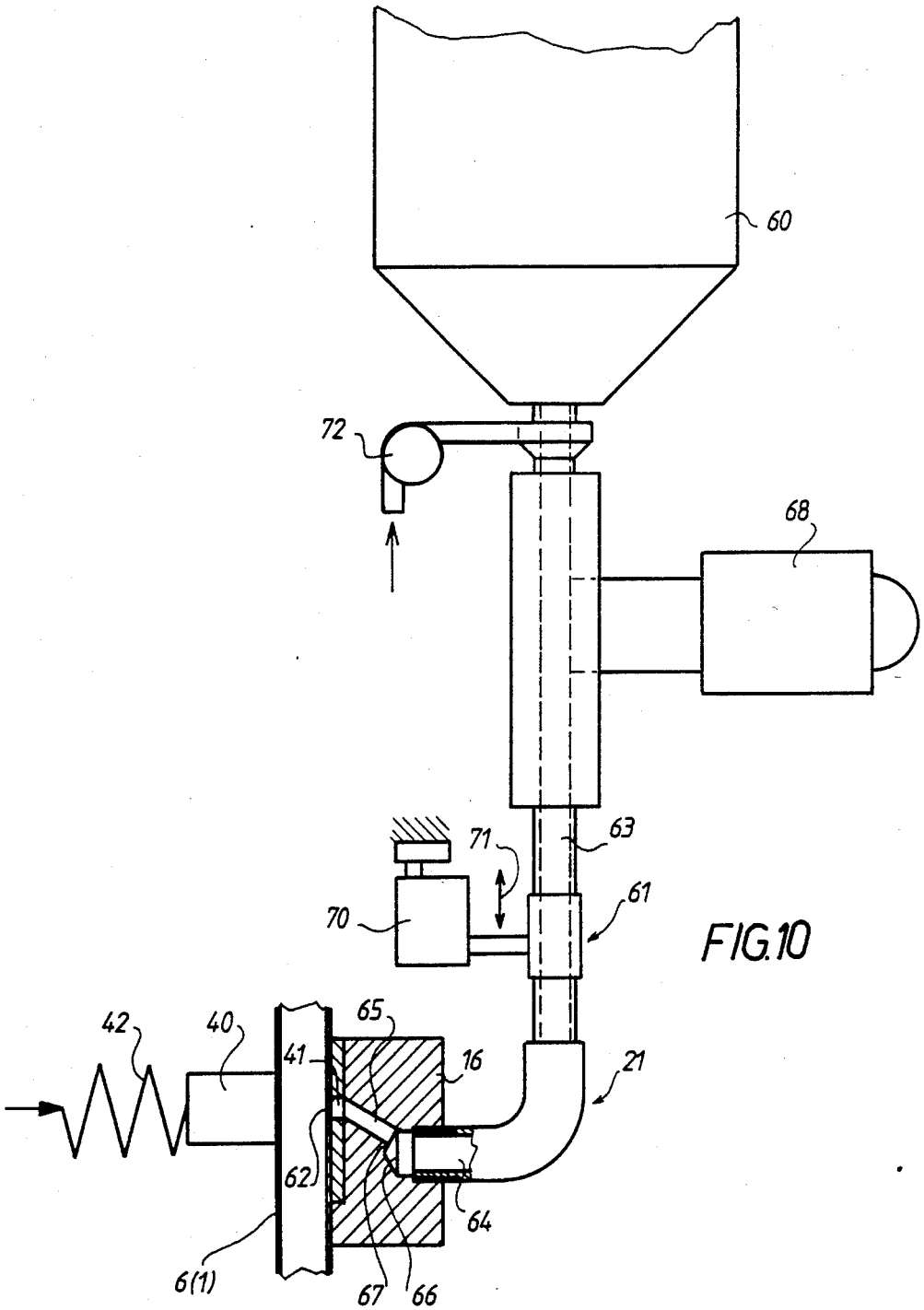

Additional details and features of the invention can be seen from the following description of preferred embodiments of the invention wherein reference is had to the drawings wherein:

FIG. 1 shows an embodiment of the apparatus of this invention with two processing arrangements, FIG. 1*a* shows one of the processing arrangements on an enlarged scale with its base plate and auxiliary plate, FIG. 1*b* shows a clamping jaw from the top in a schematic view, FIG. 2 shows, on an enlarged scale, the plate with the working openings, FIGS. 3–9 show respectively in a top view the individual stages of a filling operation with the use of the apparatus of this invention, and FIG. 10 shows the installation for feeding the granulated material pertaining to the apparatus of this invention.

An apparatus for filling spacer frames 1 intended for insulating glass panes comprises two processing arrangements 2 and 3 carried by a machine frame which is not illustrated in detail. In the embodiment shown herein, the processing arrangement 2 is placed fixedly in the machine frame, and the processing arrangement 3 is guided to be horizontally displaceable in the machine frame. Above the processing arrangements 2 and 3, a strip 4 is provided, equipped with hooks 5 on which a spacer frame 1 can be suspended in the apparatus so that the frame legs 6 and 7, associated with the processing arrangements 2 and 3, respectively, are oriented essentially vertically.

The structure of the processing arrangements 2 and 3 will be described in detail below with reference to FIGS. 1*a* and 2, using the processing arrangement 2 affixed to the machine frame as an example.

The processing arrangement 2 comprises a base plate 10 connected to the machine frame and an auxiliary plate 11 guided at the base plate so that it can be reciprocated horizontally. In detail, the auxiliary plate 11 is supported at the base plate 10 by way of a guide rail 12, guide rollers 14, supported on the base plate 10, being in contact on both sides in the zone of the lower edge 13 of the auxiliary plate 11. A pressure medium operated motor 15 is provided in the illustrated embodiment for moving the auxiliary plate 11 with respect to the base plate 10.

A plate 16 is arranged at the movable auxiliary plate 11. This plate 16 comprises a hole 17 for the passage of a drill 18 guided along the base plate 10 or—as in the embodiment—along the auxiliary plate 11, to be reciprocatable transversely to the flat extension of the base plate 10 and the auxiliary plate 11, respectively. For the forward and backward motion of the drill 18, a pressure medium operated motor 20 is provided which engages, for example, at the motor 19 for the drill 18.

Furthermore, a duct 21 for feeding granulated material terminates in the plate 16. Finally, a further duct 22 terminates in the plate 16, by way of which a compound can be introduced for resealing the filling openings produced in the legs 6 and 7, respectively, of the spacer frame 1 after completion of the filling step. This compound is stored in a cartridge 23 which can be acted upon by the plunger of a pressure medium motor 24. A further plunger 25 is associated with the duct 22, which plunger can be advanced by a pressure medium motor 26. Upon advancement of the plunger 25, the amount of compound forced by activation of the pressure medium motor 24 from the cartridge 23 into the duct 22 is urged out of the orifice 27 of the duct 22 and into the filling opening produced in the spacer frame in order to seal this opening.

For retaining the vertical leg 6 of the spacer frame 1, associated with the processing arrangement 2, a clamping device 30 is provided, carried by the base plate 10. The clamping device 30 includes a stop 31 and a pivotable clamping jaw 32 which latter is angled and is supported by way of two legs 33 on a carrier 34 connected to the base plate 10 so that this clamping jaw can be swung about a substantially vertical axis. For operation of the clamping jaw 32, a pressure medium motor 35 is provided. In the embodiment of the clamping jaw 32 shown in FIG. 1*b*, the jaw is of single-angle construction, i.e. its legs 33 stand perpendicularly to its pressure surface 36, the piston rod of the pressure medium motor 35 engaging at a projection 37. Another possibility for the structure of the clamping jaw 32 is shown in FIG. 1*a* and in FIGS. 3–9. A pressure block 40 projects between the legs 33 of the clamping jaw 32 toward the plate 16; in the resting position of the processing arrangement 2, the pressure block 40 seals the orifice 41 of the duct 21 by way of which granulated m;aterial can be introduced. The pressure block 40 is advanced under the action of a spring 42 so that the pressure block, as seen from FIG. 1, is in contact with a lateral surface of the vertical leg 6 of the spacer frame 1 and urges the same against the plate 16.

A pressure medium motor 43 is associated with the pressure block 40, by means of which the pressure block 40 can be lifted off the frame leg 6 and off the plate 16, respectively.

The pressure medium motor 43 and consequently also the pressure piston 40 are attached to the support 34 by way of an auxiliary support 44 and are thus rigidly joined to the base plate 10 of the processing arrangement 2.

Figure 3:
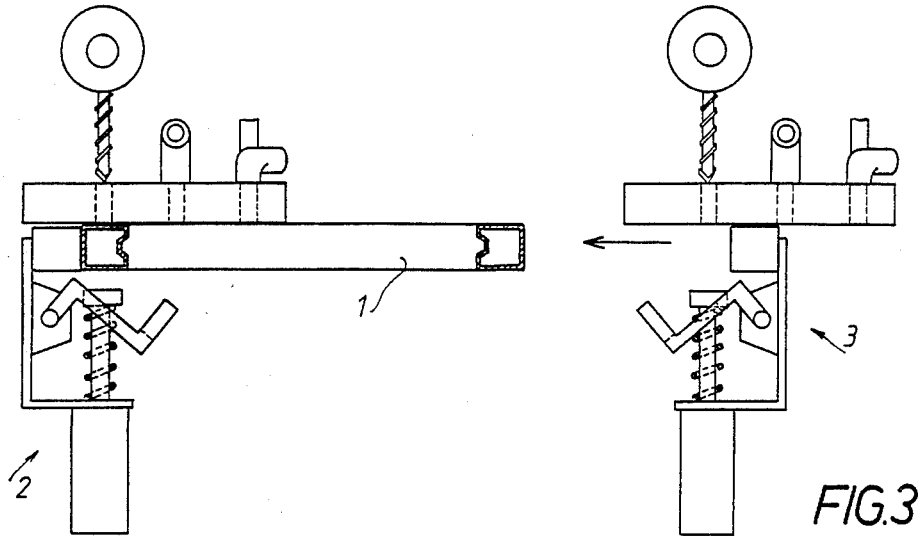

The movable processing arrangement 3 has an analogous structure, partially in mirror-image symmetry, with the condition that, in the plate 16 of the movable processing arrangement 3, the orifice 41 of the duct 21 for the granulated material, the orifice 27 of the duct 22 for the sealing compound, and the hole 17 for passing the drill 18 are arranged in the same sequence as in the plate 16 of the fixed processing arrangement 2 (compare FIG. 3 and the subsequent figures).

Furthermore, guide rails 50 are provided at the base plates 10 of both processing arrangements 2 and 3, located in the same vertical plane as the front faces of the plates 16, so that the legs 6 and 7 of the spacer frame 1 are in contact with the guide rails 50 with the spacer frame 1 being vertically suspended. Furthermore, another guide rail 51 is located at the movable processing arrangement shortly below its clamping device 30, this guide rail being in contact with the leg 7 of the spacer frame 1 from the front. These guide rails 50 and 51—the guide strip 51 is preferably attached to the auxiliary plate 11—ensure that, during adjustment of the movable processing arrangement 3, the leg 7 of the spacer frame 1 is approximately in a position correct for the activation of the clamping device 30 and moreover does not collide, during adjustment of the movable processing arrangement, with the latter (for example with the clamping jaw 32 or the plate 16).

The following description, with reference to FIG. 10 and FIG. 2, describes the device for filling the spacer frame 1 with granulated material (granular, hygroscopic material, "molecular sieve"); it is to be noted, in this connection, that this device is usable, even independently of the previously disclosed apparatus for the filling of spacer frames, in all those instances where bulk streams of granules, especially granulated material that is abrasive and easily crushable into dust, have to be regulated.

The device for filling hollow members with granulated material comprises a storage tank 60 for the granulated material connected, by way of a conduit 61, with a discharge opening 41; in the illustrated embodiment, the discharge opening 41 is provided in the plate 16 of the apparatus according to FIGS. 1 and 2. A filling opening 62 is located in opposition to the orifice 41 of conduit 61 in the hollow member to be filled, this being in the illustrated example the leg 6 of the spacer frame 1. The hollow member is urged by a pressure block 40 against the plate 16, the pressure block 40, when the hollow member is removed sealing the orifice 41. This is of importance, in particular, in case of hygroscopic granulated material (molecular sieve) as used for filling spacer frames. The conduit 61 comprises a vertical section 63, a horizontal section 64, and a section 65 that extends obliquely upwardly, the end of the obliquely upwardly extending section 65 in direct proximity to the orifice 41 being aligned substantially horizontally.

It can be seen from FIG. 10 that the sections 63 and 64 of conduit 61 have a larger cross section (diameter) than the obliquely upwardly running section 65 thereof.

The obliquely upwardly extending section 65 with a smaller cross section is offset in the upward direction with respect to the horizontal section 64, so that a step 67 is created in the transitional zone of the sections having the larger cross section to the section having the smaller cross section in conduit 61.

A vibration generator 70 is associated with the conduit 61 and/or with the storage tank 60, producing vibrating strokes 71 oriented in parallel to the section 63 of conduit 61 and acting predominantly in the downward direction.

In addition to or in place of the vibration generator, a contrivance 72 for producing a conveying gas stream, which latter is dried in case of granules consisting of a hygroscopic material, is included for conveying the granules from the storage tank 60 through the conduit 61.

A bulk stream detector 68 is correlated with the conduit 61, preferably with the vertically extending section 63 thereof, detecting movements of the granulated material through the conduit 61, for example, with the aid of the radar principle.

As soon as the hollow member to be filled is entirely saturated, and no granulated material flows any longer through the conduit 61, the filling stream detector, which at this point in time no longer detects movements of the granules, transmits a control signal which arrests the vibration generator and/or the installation for producing the conveying gas stream. Thereupon the hollow member, presently filled with granulated material, can be removed. Since the granulated material is dammed up in the transition zone 66 between the conduit sections 63, 64 with a larger cross section and the upwardly oriented section 65 of the conduit with a smaller cross section, when no vibrations are produced or when no conveying gas stream is conducted through conduit 61, there is no danger that, with the hollow member being removed, granulated material is discharged from the storage tank 60 via conduit 61 out of the orifice 41. The pressure piston 40 thus does not serve the task of preventing exiting of granules from the orifice 41 but rather is utilized exclusively for urging the hollow member against the plate 16 and sealing the orifice against access of moisture from the outside.

The mode of operation of the apparatus shown in FIGS. 1, 1*a* and 2 will be explained below, with reference to FIGS. 3–9.

Figure 4:
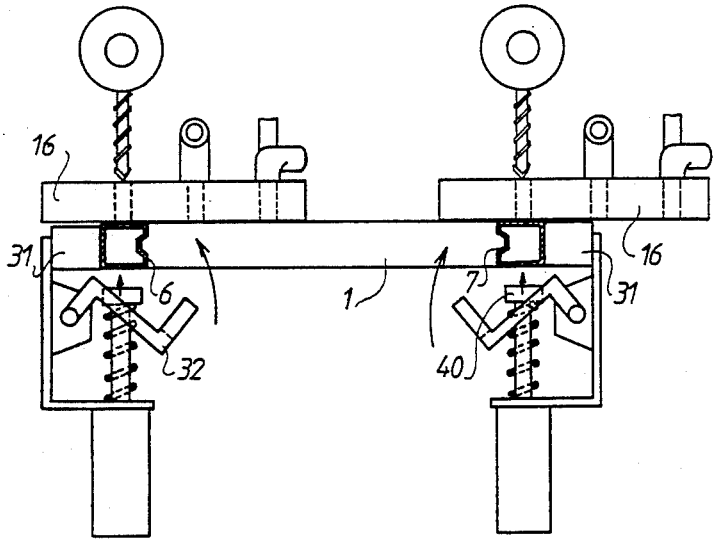

First of all, a spacer frame is suspended with its upper, horizontal leg on the hooks 5 of the hook strip 4. Subsequently, the movable processing arrangement 3, as shown in FIG. 3, is moved toward the vertical leg 6 of the spacer frame 1 until the stops 31 of the processing arrangements are in contact with the outer surfaces of the vertical legs 6 and 7. As soon as this position has been reached, the clamping jaws 32 are pivoted into their operative position wherein their contact surfaces 36 abut against the inner surfaces of the legs 6 and 7 and, preferably shortly beforehand, the pressure rams 40 are advanced so that the legs 6 and 7 of the spacer frame 1 are in contact with the plates 16 of both processing arrangements 2 and 3 (FIG. 4).

Figure 5:
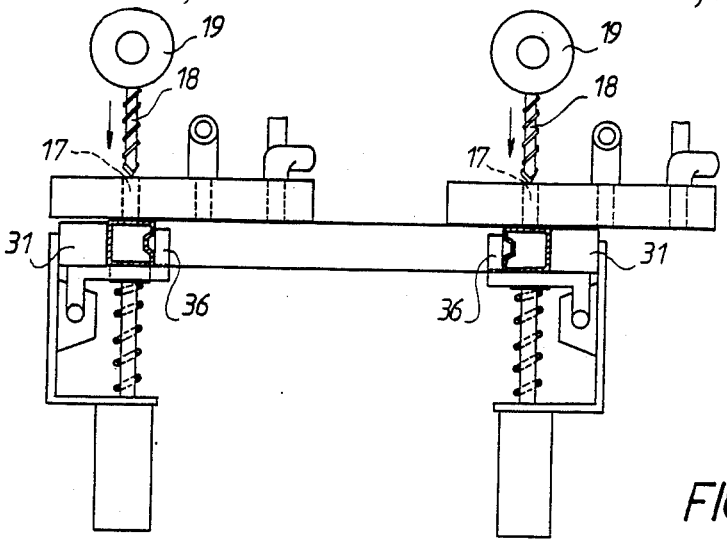
Figure 6:
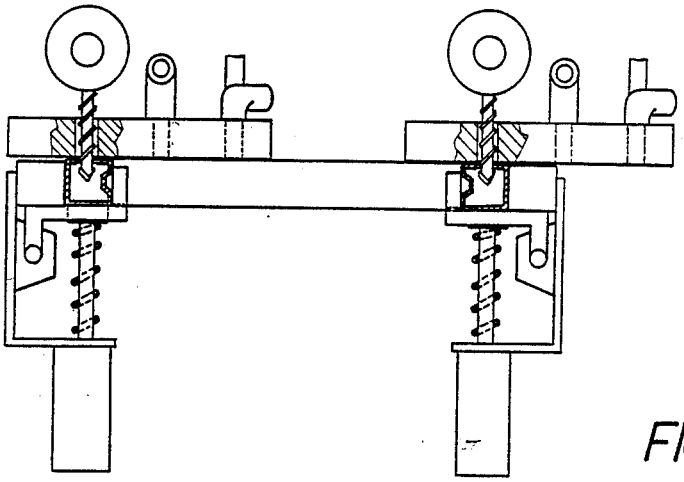

In the presently attained position, as shown in FIG. 5, the vertical legs 6 and 7 of the spacer frame 1 are arranged in opposition to the holes 17 for the drills 18 so that, as illustrated in FIG. 6, the drills 18 can become active for producing the filling openings in the spacer frame 1.

Figure 7:
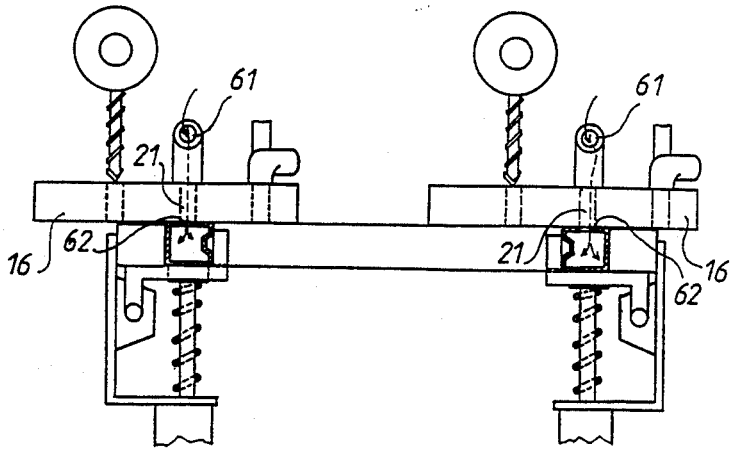

After termination of the drilling operation, the auxiliary plate 11 and thus also the plate 16 connected therewith are shifted (or, according to in embodiment that has not been illustrated, the spacer frame 1 is displaced with respect to the plate 16), so that the orifices 41 of the ducts (conduits 61) for feeding the granules face the previously produced filling openings 62. At this point, the vibration generator 70 is set into operation and/or a stream of conveying gas is produced by 72, so that the granulated material passes from the storage tank 60 via conduit 61 into the spacer frame 1 (FIG. 7).

By reactivation of the pressure medium motors 15, the auxiliary plates 11 are moved further with respect to the base plates 10 of both processing arrangements 2 and 3 by one step, after termination of the filling procedure, controlled, for example, by the bulk stream detector 68, until the orifices 27 of the ducts 22 for feeding compound from the cartridge 23 are in alignment (position according to FIG. 8). Now the pressure medium motors 24 are actuated to force a predetermined quantity of compound from the cartridges 23 into the duct 22 whereupon the pressure medium motors 26 operate the injection plungers 25 so that the amount of compound contained in the duct 22 for sealing the filling openings 62 in the vertical legs 6 and 7 of the spacer frame 1 is injected. During this step, the presently arrested piston of the pressure medium motor 24 prevents return of compound from the duct 22 into the cartridge 23. At this point in time, the plates 16 are again shifted, by operating the pressure medium motors 15, with respect to the legs 6 and 7 held by the clamping devices 30, toward the right or, as shown in FIG. 9, toward the left, in order to smooth out the compound which seals the filling openings 62.

After opening the clamping devices 30 and retracting the pressure pistons 40 by operating the pressure medium motors 43, a finished filled spacer frame can be removed from the apparatus. The just-described sequence of operations during the filling of spacer frames can take place in a partially or entirely automated fashion; for this purpose, limit switches (for example light barriers or the like), not illustrated, are associated with the apparatus, which control the movements, especially the adjustment of the movable processing arrangement 3.

It is furthermore not absolutely necessary for the frame to be at a standstill during the filling step and for the plate 16 to be moving; rather, it is also possible that the frame 1, clamped in place by the clamping devices 30, moves to and fro with respect to the plate 16.

What is claimed is:

1. In apparatus for filling hollow members with granulated material, especially for filling spacer frames for insulating glass with granular, hygroscopic material, comprising a conduit connecting a storage tank for the granulated material with a discharge opening; the improvement in which the conduit (61) for the granulated material is turned upwardly toward the discharge opening (41) and has a section, immediately upstream of the discharge opening (41), with a cross section smaller than the cross section of the remaining portion (63, 64) of the conduit (61); that the axis of the section (65) having the smaller cross section is offset in the upward direction with respect to the axis of the section of the conduit (61) in its zone adjoining the section (64) of the conduit (61) having the smaller cross section thereby to provide a step (67) between the remaining portion (64) of the conduit (61) and the lower end of the section (65) having the smaller cross section.

2. Apparatus according to claim 1, in which the storage tank (60) for the granulated material is arranged above the discharge opening (41), the section of the conduit (61) having the large cross section being turned from a vertical section (63) into a horizontal section (64) of the conduit (61).

3. Apparatus according to claim 1, in which the section (65) of the conduit (61) with the smaller cross section is oriented so that it extends obliquely upwardly.

4. Apparatus according to claim 1, in which the region of the section (65) of the conduit (61) with the smaller cross section, which is in the immediate vicinity of the discharge opening (41), extends substantially horizontally.

5. Apparatus according to claim 1, in which the end of the section (64) of the conduit (61) with a larger cross section, which adjoins the section (65) of the conduit (61) having the smaller cross section, is oriented horizontally.

6. Apparatus according to claim 1, in which the conduit (61) for the granulated material is associated with a bulk stream detector (68).

7. Apparatus according to claim 6, in which the bulk stream detector (68) monitors the movements of granulated material in the conduit (61) according to the radar principle.

8. Apparatus according to claim 1, and means for promoting flow of said material through said conduit (61).

9. Apparatus according to claim 8, the last-named means comprising a vibration generator (70) that imparts vibrations to said conduit (61).

10. Apparatus according to claim 8, the last-named means comprising a device (72) for producing a conveying gas stream in said conduit (61).

11. Apparatus for filling spacer frames for insulating glass with a hygroscopic material, comprising at least one apparatus according to claim 1, with a holder for the spacer frame to be filled, and with at least one processing arrangement mounted on a machine frame and equipped with a drilling means for producing filling openings in the spacer frame to be filled and with a device for sealing the filling openings after termination of the filling process, the holder of the processing arrangement (2, 3) including a clamping device (30) engaging at a leg (6, 7) of the spacer frame (1) and a pressure piston (40); the processing installation (2, 3) comprising a plate (16) lying in opposition to the pressure piston (40) having a contact surface extending in parallel to the plane of the spacer frame (1), wherein there are provided, side-by-side, a hole (17) for the passage of a drill (18) of the drilling means, a duct (21, 41) for the granulated material, and a duct (22, 27) for a compound for sealing the filling opening (62) in the spacer frame (1); drive motors (15) for effecting movement between a base plate (10) and the spacer frame (1) in order to place the leg (6, 7) of the spacer frame (1) in mutual opposition first with the hole (17) for the drill (18), then with the orifice (41) of the duct (21) for the granulated material, and finally with the orifice (27) of the duct (22) for the compound for sealing the filling opening (62) in the spacer frame (1).

12. Apparatus according to claim 11, in which there are two processing arrangements (2, 3), one processing arrangement (2) being located fixedly in the machine frame and the other processing arrangement (3) being guided to be horizontally reciprocable for adaptation to differing spacer frame sizes.

13. Apparatus according to claim 11, in which the pressure piston (40) for urging the spacer frame (1) against the plate (16) is located, in the rest position, facing the orifice (41) of the duct (21) for the granulated material and seals the orifice (41) with the spacer frame (1) being removed.

14. Apparatus according to claim 11, in which each processing arrangement (2, 3) has a base plate (10) and an auxiliary plate (11) displaceable with respect to the latter, the plate (16) with the hole (17) for the drill (18) of the drilling means and the ducts (21, 22) for the granulated material and, respectively, the compound for sealing the filling opening (62) in the spacer frame (1), as well as a storage cylinder (23) for the compound for sealing the opening (62) in the spacer frame (1) being disposed on the movable auxiliary plate (11), while the clamping device (30) and the pressure piston (40) are arranged on the base plate (10).

15. Apparatus according to claim 14, in which the auxiliary plate (11) is guided along the base plate (10) by way of a horizontal rail (12) and, in the zone of its lower edge (13) is guided along the base plate (10) between rollers (14).

16. Apparatus according to claim 11, and a displaceable plunger associated with a storage cylinder (23) for the compound for sealing the filling opening (62) in the spacer frame (1), this plunger being adapted to force a predetermined amount of compound, required for a sealing process, into the duct (22) provided in the plate (16) for the compound for sealing the filling opening (62) in the spacer frame (1); the duct (22) accommodating an advanceable plunger (25) for forcing the compound out of the duct (22) into the filling opening (62) in the spacer frame (1).

17. Apparatus according to claim 11, in which the clamping device (30) at the processing arrangement (2, 3) exhibits a stop (31) rigidly mounted on the base plate (10) and a clamping jaw (32) that can be brought into contact with the leg (6, 7) of the spacer frame (1) and is pivotably supported at the base plate (10).

18. Apparatus according to claim 17, in which the pivotable clamping jaw (32) is angled, and is mounted by two legs (33), oriented perpendicularly to its pressure surface (36), on the base plate (10) to be pivotable about an upright axis.

19. Apparatus according to claim 18, in which the pressure piston (40) extends through the movable clamping jaw (32) between the legs (33) thereof.

20. Apparatus according to claim 11, in which the drilling means (18, 19) is mounted on the base plate (10) to be advanceable transversely to the plane of the spacer frame (1).

21. Apparatus according to claim 11, and a strip (4) provided with hooks (5) and oriented horizontally on the frame of the apparatus, a spacer frame (1) being suspendable in these hooks (5); the processing arrangement(s) (2, 3) being associated with vertical legs (6, 7) of the spacer frame (1).

22. Apparatus according to claim 21, and guide strips (50) for the vertical legs (6, 7) of the spacer frame (1) provided at the processing arrangements (2, 3), a guide rail provided on the fixed processing arrangement (2) and a guide rail (50) provided on the movable processing arrangement being in contact with a side of the spacer frame (1) that faces the machine frame.

* * * * *